US007284639B2

(12) United States Patent
Sasaki et al.

(10) Patent No.: US 7,284,639 B2
(45) Date of Patent: Oct. 23, 2007

(54) PASSENGER ACTUATED ELEVATOR ALARM DEVICE

(75) Inventors: Hiromitsu Sasaki, Tokyo (JP); Hideaki Saso, Chiba (JP)

(73) Assignee: Otis Elevator Company, Farmington, CT (US)

( * ) Notice: Subject to any disclaimer, the term of this patent is extended or adjusted under 35 U.S.C. 154(b) by 647 days.

(21) Appl. No.: 10/842,584

(22) Filed: May 10, 2004

(65) Prior Publication Data

US 2004/0231929 A1 Nov. 25, 2004

(51) Int. Cl.
*B66B 1/34* (2006.01)

(52) U.S. Cl. ..... 187/395; 187/390

(58) Field of Classification Search ..... 187/390–396
See application file for complete search history.

(56) References Cited

U.S. PATENT DOCUMENTS 4,839,631 A * 6/1989 Tsuji ..... 340/541
5,131,508 A * 7/1992 Suzuki ..... 187/380

FOREIGN PATENT DOCUMENTS

JP 04-226050 3/1994
JP 06100259 A * 4/1994
JP 06156912 A * 6/1994

* cited by examiner

*Primary Examiner*—Jonathan Salata

(57) ABSTRACT

A signal for warning of danger in the car is sent to a monitoring chamber without a suspect noticing, and the interior of the car is monitored without alarming the suspect. A call for service is registered upon activating the car manipulating panel and an alarm is registered upon further activation of the car manipulating panel.

11 Claims, 2 Drawing Sheets

PASSENGER ACTUATED ELEVATOR ALARM DEVICE

TECHNICAL FIELD OF THE INVENTION

This invention pertains to a type of alarm device that uses a car manipulating panel to prevent criminal activity in an elevator car.

BACKGROUND OF THE INVENTION

In recent years, criminal activity by suspects who are not residents of the apartments or other buildings takes place in elevator cars. Consequently, measures have been taken to prevent suspects from entering the building or the elevator car by providing automatic locking systems at the entrance/exit of the building, providing a user identification device at the elevator landing, etc.

As other measures against criminal activity in elevator cars, a glass window may be provided in the door of the car so that the interior of the car can be seen from the landing on each floor, or a monitoring camera may be mounted in the car. In addition, an emergency button is provided inside the elevator car as a means of letting those on the outside know that criminal activity is taking place.

However, said automatic locking systems and user identification devices cannot completely prevent suspects from entering the building or elevator car. Also, when a glass window is provided in the door to prevent criminal activity in the elevator car, the criminal activity is unlikely to be discovered if nobody is in the landing. Also, said emergency button can be used to send an alarm only after the criminal activity has taken place, so that it is not sufficient for preventing the criminal activity. In addition, the monitoring camera may be assumed to be a dummy, so that mounting the monitoring camera alone is insufficient to prevent criminal activity.

The following device has therefore been proposed: the interior of the car is connected with a means of communicating with a manager's office; when the destination floor registration button is pushed inside the car, the image of the manager appears on a monitor inside the car to let persons in the car know that the interior of the car is being monitored by the manager. As a result, criminal activity can be prevented, and users of the elevator can feel safe. (See: Patent Reference 1—Japanese Kokai Patent Application No. Hei 6[1994]-72651.)

However, there may be no manager's office in the building. Also, even when a manager's office is present, the manager usually is not in. This is especially true at night when criminal activity most frequently takes place. Consequently, there is a need for the site communicating with the interior of the car not to be limited to the manager's office in the building, but also to include a remote monitoring center that monitors elevator operation, etc.

On the other hand, many elevator users do not like being monitored while using the elevator. Consequently, there is a need for a system that allows sending an alarm to the manager's office or monitoring center only when the elevator user senses danger in the presence of a suspect. Even with such a system, however, the suspect notices and thus carries out a criminal act before the user can finish manipulating the alarm device. Also, manipulation of the alarm device may aggravate the suspect and cause the criminal act. In addition, a resident may be mistaken for a suspect.

The objective of this invention is to provide a type of device characterized by the following facts: when a user and a suspect are in the same elevator car, the user can send an alarm to the monitoring room to warn of a sense of danger without being noticed by the suspect and without aggravating the suspect; at the same time, it is also possible to effect transmission to the car that the interior of the car is being monitored without aggravating the suspect.

SUMMARY OF THE INVENTION

In order to realize the aforementioned objective, this invention has the following constitution.

The subject invention provides an alarm device for an elevator including a car manipulating panel, a monitoring camera and an information transmission device in the car, and as the destination floor registering button on said car manipulating panel is manipulated, the destination floor is registered; further button manipulation can be carried out on the manipulating panel so that a message instructing monitoring of the interior of the car with the monitoring camera is sent by means of said information transmission device.

As a result, only when the elevator user senses danger due to the presence of a suspect does the user perform the prescribed manipulation of the car manipulating panel so that a message indicating that the interior of the car is being monitored is transmitted to the car as a means of preventing criminal activity in the car.

According to a further embodiment of the subject invention includes a user identification device to prevent undesired sending of alarm when a resident of the building is mistaken for a suspect, and to prevent the user from hesitating to send the alarm for fear of making such a mistake.

BEST MODE FOR CARRYING OUT THE INVENTION

In the following, an embodiment of the alarm device for an elevator of this invention will be explained in detail with reference to figures.

Figure 1:
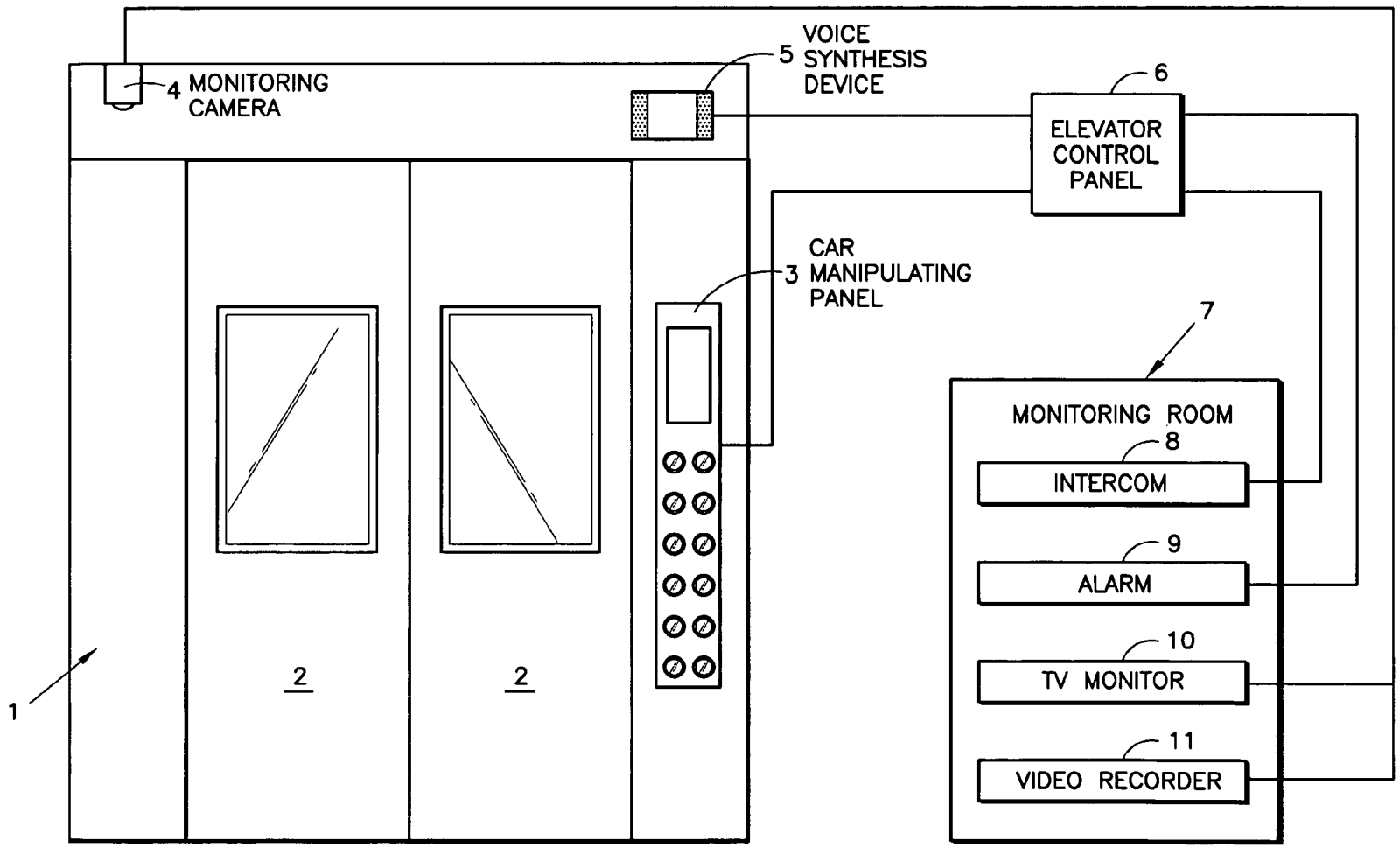
FIG. 1 is a schematic diagram illustrating an application example of the elevator alarm device of this invention.

FIG. 1 is a schematic diagram illustrating the elevator alarm device of this invention. As shown in this figure, (1) represents the front side of the interior of the elevator car. It has double doors (2), car manipulating panel (3) with destination floor registration buttons, door opening/closing button, etc. arranged on it, and voice synthesis device (5), which is provided as an information transmission device for sending messages into the car. Also, monitoring camera (4) is mounted on the ceiling of the car.

Additionally an intercom (8), alarm (9), TV monitor (10), and video recorder (11) are provided in monitoring room (7), such as manager's office in the building, or a remote monitoring center for continuous monitoring of elevator operations, etc. When the elevator user senses danger due to the presence of a suspect in the same car, the user can perform a prescribed manipulation on car manipulating panel (3). The manipulation signal goes to elevator control panel (6) and is sent to monitoring room (7), and alarm (9) in monitoring room (7) issues an alarm. As a result, the monitoring person in monitoring room (7) can monitor the situation in the car by watching the images captured by the monitoring camera (4) and displayed on TV monitor (10), and the images can be recorded by video recorder (11) as proof in the event of criminal activity. In addition, when needed, as for example when a criminal act seems about to take place, the manager can talk to the user in the car by means of intercom (8).

In addition to the aforementioned elements, other means can be utilized. For example, instead of voice synthesis device (5), a monitor can be provided in the car as an information transmission device to reinforce the transmission content. Also, video recorder (11) can be provided inside the car instead of in monitoring room (7) to simplify the operation of laying communication cables, and to reduce the cost.

Figure 2:
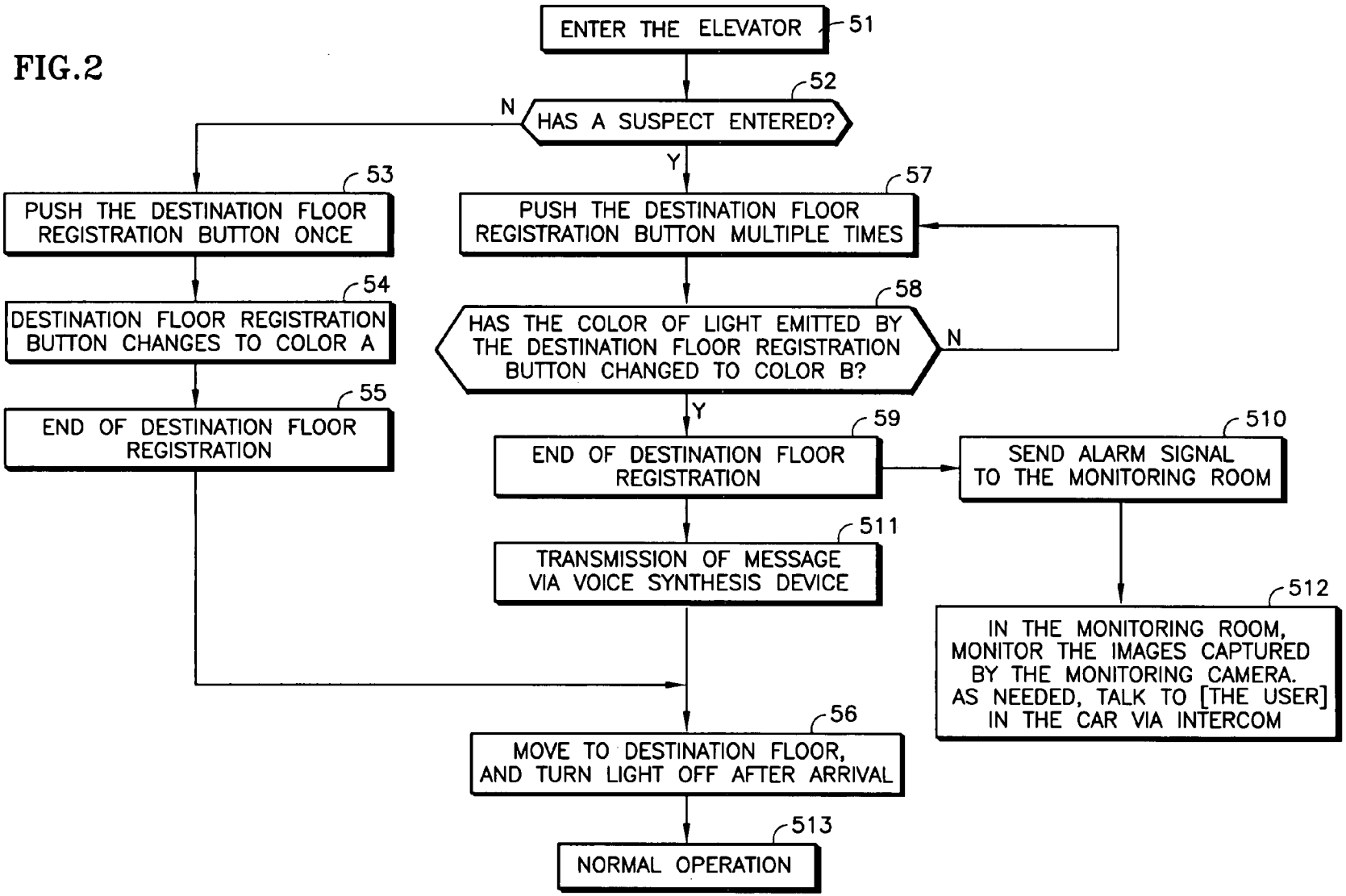
FIG. 2 is a flow chart illustrating how an alarm is sent in an example this invention.

In the following, the flow chart in FIG. 2 illustrating how an alarm is set in the alarm device of this invention will be explained.

In normal operation when no suspect is present in the elevator car, the elevator user pushes the destination floor registration button on the car manipulating panel (3) once (53). As a result, the lamp for the chosen destination floor registration button lights up in color A (such as blue)(44), and the user's destination floor is registered as the destination floor of the elevator car (55). The car then travels in the elevator shaft. When the car reaches the destination floor, the lamp for the destination floor registration button is turned off, and at the same time, the car door is opened so that the user can exit (56).

On the other hand, when a suspect enters the car and the elevator user senses danger, (52) the user first pushes the desired destination floor registration button on car manipulating panel (3) once in the same way as in conventional operation, and then pushes the button for the destination floor twice consecutively (S7). This causes the lamp for chosen the destination floor registration button to light up in color B (such as green) (58), different from that for normal operation. In this way, the user's destination floor is registered (59), and, at the same time an alarm is sent to monitoring room (7) to warn that the user senses danger (510). The alarm is sent to monitoring room (7), as indicated by the color change to color B, which, however, is known only to the building residents, and is not known by the non-resident suspect. Consequently, the suspect does not know that the user has sensed danger and has sent an alarm to monitoring room (7).

When an alarm is sent to monitoring room (7), a voice synthesis device (5) issues a message in the car such as "The situation in this car is being monitored with a camera" or the like (511). Even in this case, only residents know that such a message is issued only when an alarm has been sent to monitoring room (7). When the voice message is issued from voice synthesis device (5) after manipulation of car manipulating panel (3) it gives the impression that it might be issued automatically. Consequently, the suspect is not aggravated; while the suspect gets the impression that the situation in the car is monitored. This can prevent the criminal activity from taking place.

At the same time, when said alarm is received in monitoring room (7), monitoring and recording of the pictures from monitoring camera (4) begin (512). As required, the manager can talk to the interior of the car through intercom (8) in the event a criminal act seems about to take place. Also, measures can be taken from monitoring room (7). For example, the door will not be opened even when the car reaches the nearest floor or the destination floor so that the suspect cannot escape. Also, such measures can be preset as part of the elevator's operation control mode.

If nothing happens after the alarm is sent to monitoring room (7), the light for the destination floor registration button is turned OFF when the car arrives at the destination floor, and at the same time the car door is opened, the user gets off (S6), and the elevator returns to its normal operating mode (513).

In addition to the aforementioned elements, the following scheme can be adopted with respect to manipulation of car manipulating panel (3). For example, the user first pushes the desired destination floor registration button on car manipulating panel (3) once, and then pushes a destination floor registration button other than that of the destination floor and/or the door opening/closing button several times, or holds down a prescribed button for longer than a prescribed time. Also, it is possible to adopt a combination of these button manipulation schemes, so that each resident can be assigned a specific button manipulation scheme. As a result, it is possible to prevent mischief in sending alarms. Also, in this way, monitoring room (7) can determine which resident has sent the alarm.

The light colors for the destination floor registration buttons are not limited to blue and green. Other colors can be selected. Also, instead of changing the color of the light, it is also possible to change the light emission pattern, to produce flickering, for example.

The means for transmitting messages into the car are not limited to said voice synthesis device (5). It is also possible to adopt a recorded warning message. Also, when a monitor is provided in the car, the message can be a combination of image and voice.

Although not shown in the figure, a user identification device such as a card key reader, identification input device, fingerprint checking device, etc. can be provided on the elevator landing or on the car manipulating panel (3) inside the car. As a result, when the user rides in the elevator car, it is possible to check whether the person is a resident. For example, a chime may sound in the car to indicate that the user is a resident. This can prevent sending an alarm due to mistaking a resident for a suspect, and this also can prevent hesitation in using the system to send an alarm for fear of making such a mistake.

As explained above, appropriate adjustments can be made to prevent criminal activity according to the specific situations of the building and residents.

Although this invention has been shown and described with respect to several embodiments thereof, it should be understood by those skilled in the art that the foregoing and various other changes, omissions, and additions in the form and detail thereof may be made therein without departing from the spirit and scope of the invention as claimed herein.

We claim:

1. An alarm device for an elevator system including an elevator car and a remote monitoring location, the alarm device comprising:

an information transmission device; and, a car manipulating panel comprising a call registration device, wherein upon activation of the call registration device a call for service is entered and upon further activation of the call registration device a signal is transmitted to the remote monitoring location.

2. The alarm device of claim 1 comprising a monitoring device comprising one of a camera and a microphone for monitoring the elevator car.

3. The alarm device of claim 1, the information transmission device further comprising one of a monitor and a voice synthesis device for communicating with passengers in the elevator car.

4. The alarm device of claim 1, the call registration device further comprising an indicating means for providing a first indication upon actuation and a second indication upon further actuation.

5. The alarm device of claim 4, the indicating means further comprising a visual indicator.

6. The alarm device of claim 4 the first indication comprising a first color and the second indication comprising a second color.

7. The alarm device of claim 4, the first indication comprising a first pattern of illumination and the second indication comprising a second pattern of illumination.

8. The alarm device of claim 1 the call registration device comprising a first button for activation and further activation.

9. The alarm device of claim 1, the call registration device comprising a first button for activation and a second button for further activation.

10. The alarm device of claim 1 wherein the call activation device is activated by a manipulation and is further activated by an extended manipulation.

11. The alarm device of claim 1 further comprising a user identification device for identifying permitted passengers to prevent the transmission of false alarms.

* * * * *